United States Patent [19]

Romovacek

[11] 4,066,737

[45] Jan. 3, 1978

[54] METHOD FOR MAKING ISOTROPIC CARBON FIBERS

[75] Inventor: George R. Romovacek, Monroeville, Pa.

[73] Assignee: Koppers Company, Inc., Pittsburgh, Pa.

[21] Appl. No.: 337,457

[22] Filed: Mar. 2, 1973

Related U.S. Application Data

[63] Continuation-in-part of Ser. No. 140,474, May 5, 1971, abandoned.

[51] Int. Cl.[2] ..... B01J 3/06

[52] U.S. Cl. ..... 423/447.6; 264/29.2

[58] Field of Search ..... 423/447, 448, 449; 264/29; 208/3, 4, 6

[56] References Cited

U.S. PATENT DOCUMENTS

| | | | |
|---|---|---|---|
| 3,112,181 | 11/1963 | Petersen et al. | 423/448 |
| 3,304,192 | 2/1967 | Barrett | 106/280 |
| 3,392,216 | 7/1968 | Otani | 264/29 |
| 3,510,328 | 5/1970 | Crean | 106/273 |
| 3,595,946 | 7/1971 | Joo et al. | 423/447 X |
| 3,629,379 | 12/1971 | Otani | 423/447 X |
| 3,707,388 | 12/1972 | Kinnaird | 208/3 X |
| 3,718,493 | 2/1973 | Joo et al. | 106/273 R |
| 3,767,741 | 10/1973 | Toyoguchi et al. | 423/447 X |

*Primary Examiner*—Edward J. Meros

*Attorney, Agent, or Firm*—Herbert J. Zeh, Jr.; Oscar B. Brumback

[57] ABSTRACT

Isotropic carbon fibers are disclosed and a method is disclosed for making them from liquid hydrocarbon distillates comprising reacting the distillate with elemental oxygen to produce a pitch-like product which will yield isotropic carbon upon subsequent carbonization, forming the pitch-like product into a filament and carbonizing the filament in an inert atmosphere at temperatures in excess of 800° C wherein the distillate is reacted with the oxygen until at least 0.5 standard cubic feet of elemental oxygen is reacted per pound of distillate.

5 Claims, 1 Drawing Figure

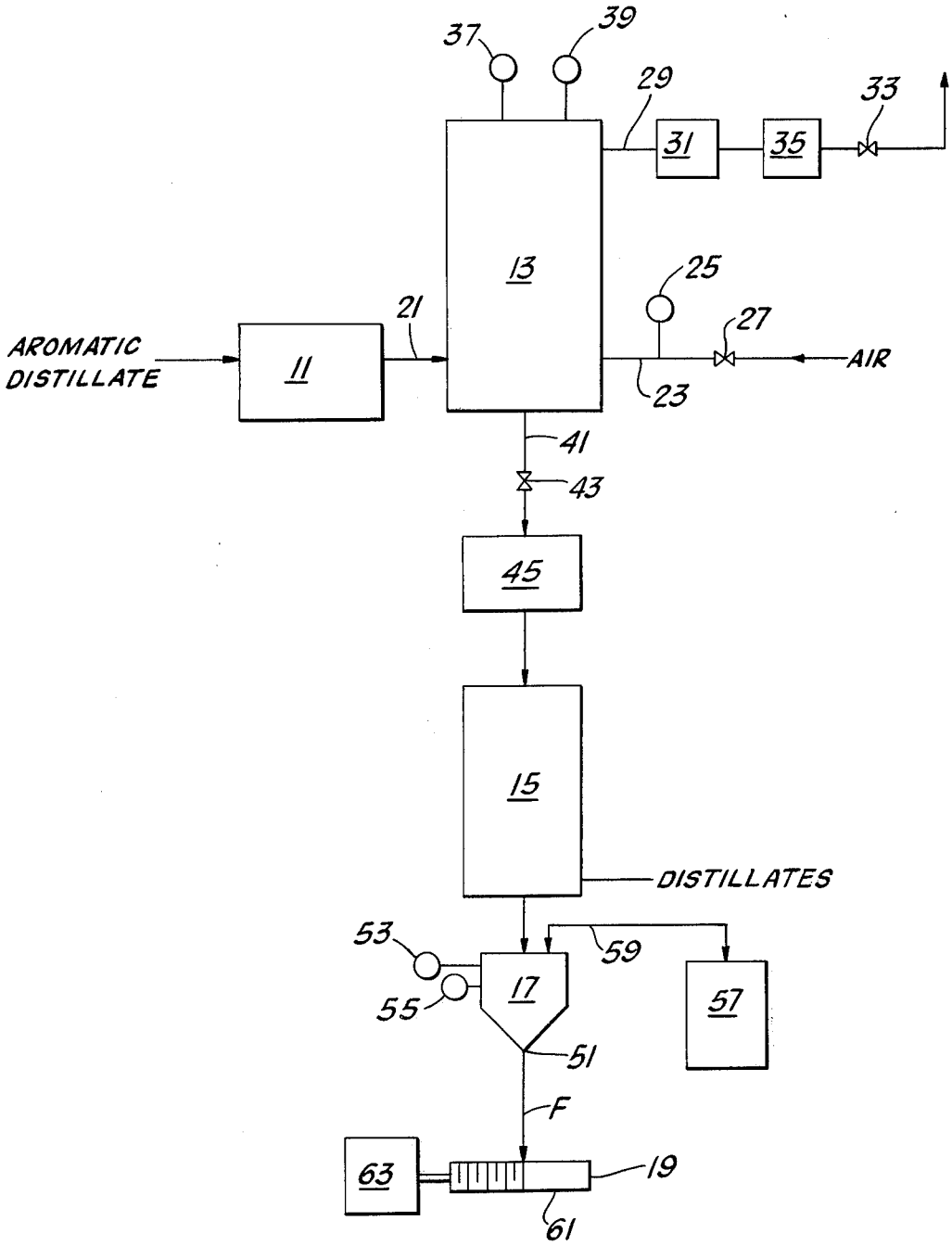
37
39
29
33
31
35
13
25
21
27
AROMATIC DISTILLATE
11
AIR
23
41
43
45
15
DISTILLATES
53
59
17
57
55
51
F
63
19
61

METHOD FOR MAKING ISOTROPIC CARBON FIBERS

This Application is a continuation-in-part of Application Ser. No. 140,474, filed May 5, 1971, now abandoned.

BACKGROUND OF THE INVENTION

This invention is directed to isotropic carbon fibers and to methods for making the same from liquid hydrocarbon distillates.

Carbon fibers have been known since 1880 when Thomas Edison first used a carbon fiber as an incandescent lamp filament. Presently carbon fibers are being incorporated into other materials such as, for example, metals, polymers, carbon, graphite, ceramics and the like to make carbon fiber reinforced composites that have improved mechanical, thermal and electrical properties. Such composites are used particularly in the present aerospace industry as the thermally stable and ablative material.

Heretofore, two basically different filaments have been made from carbon. One type is known as a carbon fiber and is made by baking carbonaceous materials at relatively low temperature (about 1000° C) and the second type is known as graphite fiber and is made by heating carbon fibers at relatively high temperatures (about 2500° C or higher.) The graphite fibers are stronger than carbon fibers. Graphite fibers have a tensile strength of about 80,000–160,000 psi and a modulus of elasticity of about 50.0–100.0 $\times$ $10^6$ psi and carbon fibers have a tensile strength of about 80,000–160,000 psi and a modulus of elasticity of about 6.0 – 8.0 $\times$ $10^6$ psi.

Isotropic carbon as used herein refers to elemental carbon having a physical structure such that it has the same physical and chemical properties in any given spatial direction. In appearance, isotropic carbon is a hard, glass like infusible shiny black substance. Whether a particular sample of carbon is isotropic carbon or anisotropic carbon (i.e. having a physical structure such that it exhibits different physical and chemical properties according to its structural orientation) is determined by the miscroscopic observation of a sample of the carbon in a metallographic microscope. Typically, a sample of the carbon is mounted in an epoxy-type resin mount and polished to a mirror smooth surface finish. The polished surface is observed under a conventional metallographic microscope in reflected polarized light with cross Nicols. If the sample is isotropic carbon there will be no change in the intensity of reflected polarized light as the sample is rotated; however, the intensity of the reflected polarized light will change upon rotation if the sample is anisotropic carbon.

Another unique characteristic of isotropic carbon is that it is nongraphitizing. In general, carbons can be classified into graphitizing and nongraphitizing carbons. Examples of the former carbon are pitch and petroleum cokes. Examples of non-graphitizing carbons are those derived from polyvinylidene chloride, cellulose, sucrose and the like. For graphitizing carbons the term soft carbon is often used and for non-graphitizing the term hard carbon or turbostratic carbon is often used. Isotropic carbon can be partially graphitized only with difficulties. If isotropic carbon is subjected to temperatures of 2500° C or higher graphite is only formed to a very limited extent.

Isotropic carbon is characterized further by being very resistant to attack by strong mineral acids including hydrofluoric acid. It also has a lower rate of oxidation than other forms of carbon. The internal friction of isotropic carbon is only a fraction (about ¼) of other non-crystalline carbons.

Isotropic carbon is not new and is well repented in the literature. See, for instance, the article by T. Yamaguchi in Carbon, Vol. 1, 47–50 (1963) and the article by T. Tsuzuku and H. Kobayashi at Pge. 539 of the Proceedings of the Fifth Carbon Conference. In addition, see the article by Fitzer, Schoefer and Yomada in Carbon, Vol. 7, pp. 643–648 (1969.) Isotropic carbon is also the subject of several patents. See for example, British Pat. No. 1,182,455 which is directed to preparation of isotropic carbon from pitches reacted with ammonium sulphate. In addition, see Krellner, U.S. Pat. No. 3,284,371 which is directed to isotropic carbon for electrographitic brushes.

Heretofore the most common method for preparing isotropic carbon was by carbonizing highly crosslinked macromolecular structures which, in addition to carbon and hydrogen, contain oxygen, nitrogen or sulfur. Carbonization of such components form rigidly crosslinked aromatic planes which prevent further conversion to a graphite structure. Examples of some of these compounds are sucrose, cellulose, rayon, furfural phenolic resin, phenol formaldehyde resins, acetone furfural polymers, polyvinylchloride, polyvinylidenchloride and polyacrylonitirile.

Carbon fibers are also known in the art. For example, see the article by S. Otani found in Carbon, Vol. 3, pp. 31–38 (1965); Carbon Vol. 3, pp. 213; and Carbon Vol. 4, pp. 425–432 (1966). Several recent patents are also directed to carbon fibers. See Otani, U.S. Pat. Nos. 3,392,216 and 3,629,379. In addition, see Joo et al, U.S. Pat. No. 3,595,946 and Shea et al, U.S. Pat. No. 3,668,110. However, none of the fibers cited above are isotropic carbon fibers which were made from hydrocarbon distillates.

Therefore, it is the object of this invention to provide isotropic fibers and a method for making the same from liquid hydrocarbon distillates.

SUMMARY OF THE INVENTION

This invention relates to isotropic carbon fibers and to a method for making the same from liquid hydrocarbon distillates. This method comprises reacting the hydrocarbon distillate with a gas containing elemental oxygen at reaction temperatures of from about 250° to about 420° C until the resulting distillate will yield isotropic carbon upon subsequent carbonization. This means that at least about 0.5 standard cubic foot (scf) of elemental oxygen has reacted with 1 pound of the distillate to produce a pitch-like substance. The pitch-like oxidized distillate is then formed into a filament and finally carbonized in an inert atmosphere at temperatures in excess of 800° C to produce isotropic carbon fibers.

In accordance with the preferred method of this invention a selected hydrocarbon distillate is converted from a substance having oily characteristics to a substance having pitch like characteristics by reacting the distillate with a gas containing elemental oxygen under conditions of elevated temperatures and at pressures that are sufficient to suppress the vaporization of the distillate at the elevated temperatures until the distillate changes to a pitch like substance. Thereafter the low boiling constituents of the oxidized distillate are distilled from the pitch-like oxidized distillate. The residual substance from the distillation, having pitch-like characteristics, is extruded as a filament and its tendency to melt or sinter is suppressed so that the filament retains its shape upon subsequent carbonization. The filament is subsequently carbonized in an inert atmosphere at temperatures in excess of 800° C to produce an isotropic carbon filament. The amount of elemental oxygen reacted with the hydrocarbon distillate is at least about 0.5 standard cubic foot of elemental oxygen per pound of distillate. The oxygenation reaction is run at a temperature of from about 250° to about 420° C.

The initial step in the method of my invention is the reaction of the hydrocarbon distillate with oxygen. The reaction of hydrocarbon distillates with oxygen is not new and is well documented. For example, see the following U.S. Patents which are directed to the reaction of oxygen and hydrocarbon distillates: Hennebutte, U.S. Pat. No. 1,044,175; Barrett, U.S. Pat. Nos. 3,304,191 and 3,304,192; Crean, U.S. Pat. No. 3,510,328; Petersen et al, U.S. Pat. No. 3,112,181; and Kinnaird, U.S. Pat. No. 3,707,388. However, none of the above patents teach the criticallity of oxygen concentrations for making isotropic carbon. In fact, none of these patents teach about isotropic carbon and many of the oxidized distillates are expressly stated to be graphitizable.

The expression hydrocarbon distillate as used herein refers to both coal tar distillates and petroleum distillates. The expression coal tar distillates refers to the distillate substances that are derived from the distillation of coal tar. The expression petroleum distillate refers to the material separated from a crude or synthetic petroleum oil by physical means such as, for example, distillation or extraction.

Both coal tar distillates and petroleum distillates may be used in the practice of the invention. The preferred coal tar distillates to be used in the practice of the invention are the distillate oils that have a boiling point range from 200°–400° C and usually comprise the so-called light, medium and heavy tar oil fractions. Such fractions are readily and commercially available from a number of sources. The physical properties of a typical coal tar distillate in an original unoxidized state and after reaction with the minimum oxygen concentration for use in the practice of the invention are given in the table below:

Table I

| Physical Properties | Coal Tar Distillate | Oxidized Coal Tar Distillate |
|---|---|---|
| Softening Point (Ring & Ball) | — | 80–120° C |
| Benzene Insolubles | Trace | 20.0–40.0% by Wt. |
| Quinoline Insolubles | Trace | 0.3–0.5% by Wt. |
| Conradson C. V. | 2–5% | 30–50% by Wt. |
| Distillation (ASTM D246) | | |
| IBP (Initial Boiling Point) | 200° C | |
| Cumulative Distillate | | |
| to 210° C | 0% | — |
| to 235° C | 2.1% | — |
| to 270° C | 12.6% | — |
| to 315° C | 36.3% | 3.3% |
| to 355° C | 80.2% | 38.2% |
| Residue over 355° C | 19.2% | 55.0–70.0% |
| Elemental Composition | | |
| Carbon | 89.0–94.0 by Wt. | 90.0–92.0% by Wt. |
| Hydrogen | 4.0–7.0 by Wt. | 4.0–5.0% by Wt. |
| Oxygen | 1.0–2.0 by Wt. | 2.0–4.0% by Wt. |
| Sulfur | 0.2–0.8 by Wt. | 0.2–0.6% by Wt. |
| Nitrogen | 1.0–2.5 by Wt. | 1.0–1.5% by Wt. |

The preferred petroleum distillates to be used in the practice of the invention are the straight-run distillates boiling between 200° and 600° C and catalytically cracked recycle oils boiling between 200° and 500° C. Such distillates are readily and commercially available from a number of sources. The physical properties of a typical petroleum distillate in an original unoxidized state and after reacting with the minimum amount of oxygen for use in the practice of the invention are given in the table below:

Table II

| Physical Properties | Petroleum Distillate | Oxidized Petroleum Distillate |
|---|---|---|
| Pour Point | — | 73° C |
| Distillate Range (ASTM D246) | — | |
| IBP (Initial Boiling Point) | 267° C | 283° C |
| Cumulative Distillate | | |
| to 270° C | 1.3% | — |
| to 300° C | 31.3% | 8.1% |
| to 315° C | 47.3% | 19.2% |
| to 355° C | 78.9% | 30.3% |
| to 375° C | 87.5% | 44.6% |

The critical feature of the invention is the threshold amount of elemental oxygen that must combine with the hydrocarbon distillate to produce the pitch-like substance. It has been found that a minimum of 0.5 standard cubic foot (scf) of elemental oxygen must be reacted with each pound of hydrocarbon distillate in the contact reaction with the hydrocarbon distillate to produce a pitch-like substance that is a satisfactory precursor for making isotropic carbon. At a reaction of less than 0.5 scf of oxygen per pound of distillate, the resultant product yields anisotropic carbon upon subsequent carbonization. The elemental oxygen consumption is conveniently measured by oxygen balance as the difference between the amount of elemental oxygen charged into the hydrocarbon distillate and the amount of elemental oxygen that leaves the hydrocarbon distillate during the reaction of the oxygen containing gas with the distillate.

The elemental oxygen gas useful in this invention may be pure oxygen gas or a combination of oxygen gas with other gases. The preferred oxygen containing gas from an economic standpoint as well as a materials handling standpoint is air.

In the preferred embodiment of the invention air is uniformly dispersed throughout the hydrocarbon distillate by blowing air into the hydrocarbon distillate at temperatures of 250°–420° C; however, the preferred temperature range is between about 350°–370° C. In this preferred temperature range the reaction rate of elemental oxygen with the hydrocarbon distillate is so fast that the concentration of residual oxygen in the exit gases may be maintained below the lower explosion limit of the exit gases that are saturated with hydrocarbon vapors. To suppress the vaporization of the hydrocarbon distillate at these temperatures the air blowing may be carried out under pressure, preferably at 80–100 psi. The air should be dispersed throughout the hydrocarbon distillate in a fine and intimate dispersion to achieve a high reaction rate.

Upon the intimate contacting of the air with the hydrocarbon distillate in accordance with this invention the hydrocarbon distillate changes in character from an oily liquid to a pitch-like substance. The pitch-like substance has physical properties that render it a good precursor for making isotropic carbon. Typical properties of the pitch-like substance (the oxidized hydrocarbon distillates) are illustrated in the two tables above.

The manner by which the liquid hydrocarbon distillate is converted to a pitch-like substance is not well understood. It is believed, however, that oxygen induces the formation of free radicals from hydrocarbon molecules which readily recombine and increase the molecular weight of the distillate. Some of the oxygen that has reacted with the distillate subsequently escapes therefrom in the exit gases as water vapor, however, some of the oxygen remains incorporated in the pitch-like substance. This oxygen which remains incorporated in the pitch substance is thought to contribute to the difficult graphitization of the isotropic carbon when it is pyrolyzed in an inert atmosphere.

In most cases the crude oxidized distillate comprises a major portion of relatively higher boiling constituents and a minor portion of relatively lower boiling constituents. It is sometimes necessary to remove these lower boiling constituents from the crude oxidized distillate, preferably by conventional distillation techniques, to raise the viscosity and the softening point of the oxidized distillate so that it may be subsequently processed without difficulty.

The softening point (cube in air) of the distilled oxidized distillate should be from about 80°-200° C after distillation, preferably about 120°-170° C. If on the other hand, the softening point is greater than 200° C then the distilled oxidized distillate will be too rigid and stiff for subsequent forming operations.

The oxidized distillate is then formed into a filament or fiber by extruding the oxidized distillate through a spinneret or a bushing having a plurality of die orifices at temperatures of about 120°-300° C. Usually the temperature of the oxidized aromatic distillate is maintained about 40° to 50° C above its softening point so that the oxidized distillate possesses good spinning characteristics. Preferably, the filaments from each orifice are collected and connected to a high-speed winding device that draws the filaments through the spinneret and winds the filaments onto a bobbin that is carried by the winding device. Consequently, the filaments are under tension and this tension draws down the diameter of the filaments to a diameter that is much smaller than the diameter of the orifices. The diameter of the fibers may therefore be precisely controlled by controlling the temperatures of the oxidized distillate, the orifice size of the spinneret and the rate of speed at which the fibers are pulled from the orifices by the winding device.

After the oxidized distillate has been formed as a filament it optionally may be treated so that it has a greater tendency to keep its shape upon subsequent carbonization. To this end the softening point of the exposed surface of the filament is increased by impinging the surface of the filament with a gas, preferably a relatively hot air stream having a temperature of about 130°-150° C. Preferably the gas just flows past the filament as it is believed that the hot air stream impinging on the surface of the filament for a short time removes from the surface any lower boiling constituents therein and induces the formation of free radicals, as previously described herein, which react with other hydrocarbon molecules near the filament surface and converts it into infusible layer.

The fibers are carbonized by heating them to at least about 800° C in an inert atmosphere in a short period of time. The fibers so carbonized have physical properties that render them useful in many applications. Typical properties of isotropic carbon fibers made in accordance with the invention are:

Diameter; 5-15 Microns
Elongation at Break; 1.2-2.0%
Modulus of Elasticity; 6-8 $\times$ $10^6$ psi
Tensile Strength; 100,000 - 180,000 psi
Elemental Composition;
Carbon, 93.0-97.0%
Hydrogen, 0.2-0.6%
Oxygen, 0.5-3.0%
Sulfur, Less than 0.6%
Nitrogen, Less than 0.2%

The drawing illustrates schematically an embodiment of an apparatus for use in the practice of this invention.

The drawing shows a device for use in the practice of the invention. The device comprises basically of a preheater 11, a pressurized vessel 13, a distillation unit 15, a filament or fiber extruder 17, a winding device 19.

The preheater 11 is conventional and it preheats the crude distillate to a temperature of about 250°-400° C. The vessel 13 is a conventional pressurizable tank. Preheater 11 is connected to the bottom of vessel 13 by conduit 21. Vessel 13 is connected at its bottom to a source of air by conduit 23 as shown in the figure. The flow of air through conduit 23 into vessel 13 is controlled by regulator 25 and valve 27.

At the top of vessel 13 a conduit 29 carries off the waste gases from vessel 13 into heat exchanger 31 and eventually such gases are expelled into the atmosphere via valve 33. An oxygen analyzer 35 determines the concentration of elemental oxygen in the waste gases passing through conduit 29. Vessel 13 has a conventional temperature gauge 37 and a conventional pressure gauge 39 for monitoring the temperature and pressure in the vessel 13.

At the bottom of vessel 13 there is a conduit 41 and valve 43 for withdrawing the oxidized distillate from the vessel 13. The oxidized distillate is charged into storage vessel 45 and subsequently into distillation unit 15. The softening point of the crude oxidized distillate is adjusted to about 80°-200° C by conventional distillation in unit 15. The distillates are withdrawn from the unit and recycled as described and the residue from such distillation is processed further in extruder 17. Extruder 17 includes a means such as an electric furnace (not shown) for heating and maintaining the temperature of the oxidized distillate at about 120°-300° C. At the bottom of the extruder 17 there is provided a conventional spinneret 51 having at least one, and preferably, a plurality of die orifices of about 500 microns in diameter through which the oxidized aromatic distillate is extruded to form filament F. The extruder includes a conventional temperature gauge 53 and a conventional pressure gauge 55 for monitoring the temperature and pressure in the extruder. A pressure source 57 communicates with the extruder by conduit 59 for supplying the pressure needed to extrude the oxidized aromatic distillate through the spinneret 51. Preferably the pressure source is pressurized nitrogen gas.

Beneath extruder 17 there is provided the winding device 19 that includes a bobbin 61 and a motor 63 for turning the bobbin 61. The filament F is collected on bobbin 61 as shown.

In the preferred practice of the invention a hydrocarbon distillate is received by preheater 11 and heated to a temperature of about 350°14 370° C therein and subsequently it is charged into vessel 13 via conduit 21 as shown in the FIGURE. The pressure in the vessel is increased to about 85°-100° C psi sufficient to suppress vaporization of the aromatic distillate at its elevated temperature. Air is introduced into the bottom of vessel 13 through conduit 23 into a plurality of ports (not illustrated in the FIGURE) to insure an intimate admixture of the air with the distillate. The flow of air into the vessel is regulated by flow regulator 25 at a preferred rate of about 0.2°–2.5 scf of air per hour per pound of distillate. As the air enters the distillate at the bottom of the vessel it bubbles upwardly through the distillate to convert it to the pitch-like substance. The gases evolving from vessel 13 pass through conduit 29 and pass into heat exchanger 31 where they are cooled and thence to analyzer 35 where they are analyzed for oxygen content. The concentration of oxygen in the gases should be maintained at levels below explosive limits in the vessel 13. As the air bubbles upwardly through the distillate in vessel 13 the viscosity of the distillate increases and the amount of benzene insolubles in the distillate also increases.

When the viscosity of the distillate reaches about 10 Saybolt seconds at 100° C and the benzene insolubles reach about 30.0% by weight the distillate will have been converted to a pitch-like substance that is a suitable precursor for making isotropic carbon fibers. In practice, however, the amount of oxygen consumed is the determining factor in deciding when the distillate has been sufficiently treated. When greater than 0.5 scf of elemental oxygen per pound of distillate have been consumed, the flow of air is shut off by valve 27, and the pressure is reduced in vessel 13 by valve 33. The contents of the vessel are discharged through conduit 41 into storage vessel 45 and thence into distillation unit 15 where the lower boiling constituents are removed and a residue is obtained having the desired softening point.

In the extrusion of filaments (F) in the FIGURE the oxidized distillate is extruded through the die orifices of spinneret 51. At the start of the operation the end of the filament is secured to bobbin 61. In operation the motor 63 turns bobbin 61 at a specified speed such that the filament is drawn by tension from 500 microns, the intital size of the filament, down to 10–15 microns diameter.

Subsequently, the bobbin 61 is removed from the winding device 17; the filaments on the bobbin are contacted with hot air and subsequently carbonized at temperatures in excess of 800° C. The resulting carbonized filament is infusible, shiny black, hard and has generally those characteristics of isotropic carbon.

Numerous experiments have been performed which demonstrates the invention. The following examples are illustrative of these experiments. They should be construed to illustrate the invention but not to limit the same.

EXAMPLE 1

A series of carbon fibers of different diameters were prepared using the method of my invention. The starting material was a coal tar distillate. The distillate was reacted with oxygen (air) at a temperature of about 360° C until greater than ½ scf of elemental oxygen had reacted with every one pound of distillate. The oxidized distillate was then vacuum distilled to remove the low boiling constiuents. The filaments were then prepared by spinning the oxidized distillate. The filaments were carbonized under a nitrogen atmosphere in a tubular furnace by raising the temperature 1°/min. to 520° C and 3°/ min. to 1000° C.

The mechanical properties of the fibers were measured by mounting individual fibers on a paper card using an epoxy resin to bond each fiber at two points one inch apart. The card was provided with a cut out slot across its length. The card was mounted into the jaws of an Instron Universal testing machine. The sides of the card were cut so that the filament remained the only connection between the upper and lower jaw. The fiber was tested under the following conditions:

Gauge length = one inch
Crosshead speed = 0.02 inch/min.
Instron load cell = Type C
Chart speed = 5 inches/min.
Chart full scale deflection = 100 g.

The results are shown in Table I. Included for comparison are data obtained for carbon fibers prepared from rayon (A) and carbon fibers prepared from pitch in accordance with Otani, U.S. Pat. No. 3,629,379 (B). The density and ultimate analysis of the various carbon fibers are also shown. All of the carbon fibers were embedded into an epoxy resin and observed in an optical metallographic microscope using a magnification of 800 polarized light and crossed Nicols. The results showed that the carbon fibers of the present invention were isotropic.

Table I

Characteristics of Carbon Fibers

Mechanical Properties:

| Product | Diameter, microns | Ultimate Tensile Strength psi UTS × $10^{-5}$ | Modulus of Elasticity psi E × $10^{-6}$ |
|---|---|---|---|
| A | 8 | 1.15 ± 0.18 | 7.0 ± 0.4 |
| B | 9–14 | 1.21 ± 0.02 | 7.05 ± 0.8 |
| Ex. 1 | 16–18 | 1.33 ± 0.23 | 8.6 ± 1.5 |
| | 20–22 | 1.00 ± 0.15 | 7.3 ± 0.6 |
| | 24–26 | 0.98 ± 0.01 | 5.8 ± 0.66 |
| | 33–35 | 0.99 ± 0.2 | 7.0 ± 0.7 |
| | 40 | 0.7 ± 0.01 | 5.0 ± 0.5 |
| | 45–46 | 0.6 ± 0.01 | 4.5 ± 0.7 |
| | 50 | 0.6 ± 0.02 | 5.5 ± 0.5 |
| | 53–55 | 0.6 ± 0.06 | 4.9 ± 0.2 |
| | 59–60 | 0.6 ± 0.08 | 4.0±0.4 |
| | 68–70 | 0.4 ± 0.03 | 4.1 ± 0.9 |
| | Ex. 1 | B | A |
| Density, g./cm³ | 1.56 | 1.61 | |
| Ultimate analysis, C% | 98.3 | 99.96 | 99.57 |
| H% | 0.49 | 0.28 | 0.22 |
| N% | <0.10 | <0.10 | <0.10 |
| S% | <0.30 | <0.30 | <0.30 |
| O% (direct) | 1.05 | 0.44 | |

EXAMPLE 2

A series of carbon fibers were prepared in a manner similar to Example 1. The only difference was that the filaments were subjected to impingment with warm air after being formed but before carbonziation. The resulting fibers had the same properties as those from Example 1. The advantage of using this treatment with air is that it reduces the tendency of several filaments to fuse together during carbonization.

The graphitization index "g" was determined for a sample of isotropic carbon of my invention. Index "g" was determined on the basis of x-ray data (measured after heating the carbonized sample to 3000° C in an inert atmosphere) to be about 0.12. The value of "g" is one (1) for graphitizable carbons. The index was computed from the following formula:

$$g = \frac{d002 - 3.35}{3.45 - 3.35}$$

where $\alpha 002$ is the average distance between two graphite planes, 3.45A is the distance between the planes at the beginning of graphitization; 3.35A is the distance between the planes at the end of graphitization. The $\alpha 002$ was computed from the Brugg equation:

$$d002 = \frac{\lambda}{2 \sin \alpha 002}$$

where $\lambda$ wavelength of x-radiation $\alpha 002$ is the angle corresponding to the maximum of 002 peak. The crystallite size Lc for my isotropic carbon is 60A compared with 210A for regular carbon pitch which was not reacted with oxygen according to my invention. The isotropic carbons of my invention have value "g" which are less than 0.2, preferably around 0.1.

The following examples 3–6 illustrate that there is a critical threshold of oxygen that must be reacted with the hydrocarbon distillate in order that the resulting carbonized fiber will be isotropic. If less than the critical amount is used, the resulting fiber will be anisotropic. However, a several fold increase in the amount still yields isotropic carbon. The excess oxygen does not have any adverse effects on the hydrocarbon distillate being converted to isotropic carbon.

EXAMPLE 3

1550 grams of coal tar distillate (creosote oil) were charged into a closed reaction vessel and were heated to a temperature of 316° C and were oxidized or blown with air for 4 hours at elevated pressure of 86 psig while maintaining the distillate at a temperature of 316° C. The air was introduced as a fine dispersion of air into the coal tar distillate at the bottom of the reactor at a rate of 1.32 scf/kg/hr. From an oxygen balance, it was found that the total amount of elemental oxygen that was consumed was about 42 gms. of elemental oxygen per kilogram of coal tar distillate. The air-blown oxidized distillate had the following distillation range as determined by ASTM test D246:

| | |
|---|---|
| IBP (Initial Boiling Point) | 231° C |
| Cumulative Distillate | |
| to 270° C | 4.8% |
| to 300° C | 12.2% |
| to 315° C | 16.5% |
| to 355° C | 53.6% |

An aliquot of the air-blown distillate was removed from the reaction vessel and placed into a refractory dish in the electric kiln. The kiln was purged with nitrogen gas. The aliquot was carbonized in the kiln by gradually heating it at a rate 3°/minute up to 1000° C and holding it at that temperature for 1 hour while the inert atmosphere of nitgrogen gas was maintained in the kiln.

A sample was prepared from the carbonized aliquot and examined under a metallograhic microscope at a magnification of 800X using reflected polarized light and crossed Nicols. The sample was identified as isotropic carbon as the intensity of the reflected polarized light did not vary as the sample was rotated perpendicular to the axis of observation.

EXAMPLE 4

1620 grams of coal tar distillate (creosote oil) were charged into a closed reaction vessel. The coal tar distillate had the following distillation range as determined by ASTM test D246:

| | |
|---|---|
| IBP (Initial Boiling Point) | 220° C |
| Cumulative Distillate | |
| to 235° C | 2.1% |
| to 270° C | 12.6% |
| to 315° C | 36.3% |
| to 355° C | 80.9% |
| Residue | 19.2% |

The coal tar distillate in the reaction vessel was heated to a temperature of 316° C and was oxidized or blown with air for 4 hours at atmospheric pressure while maintaining the distillate at a temperature of 316° C. The air was introduced as a fine dispersion of air into the distillate at the bottom of the reactor at a rate of 0.90 scf/kg/hr. From an oxygen balance, it was found that the total amount of elemental oxygen that was consumed was 30 gms. of elemental oxygen per kilogram of the distillate. An aliquot of the air-blown coal tar distillate had the following distillation range as determined by ASTM test D246:

| | |
|---|---|
| IBP (Initial Boiling Point) | 230° C |
| Cumulative Distillate | |
| to 270° C | 6.7% |
| to 300° C | 16.1% |
| to 315° C | 19.8% |
| to 355° C | 59.4% |

This aliquot of air-blown coal tar distillate was placed into a refractory dish and placed into a conventional electrical kiln. The kiln was subsequently purged with the nitrogen. The aliquot was carbonized in the kiln by gradually heating it at a rate of 3°/minute up to 1000° C and holding it at that temperature for 1 hour while the inert atmosphere of nitrogen gas was maintained in the kiln.

After the air-blown coal tar distillate was carbonized, a sample was prepared from it as above described and examined under a metallographic microscope at a magnification of 800X using reflected polarized light and crossed Nicols. The sample was identified as anisotropic carbon as the intensity of reflected polarized light did vary as the sample was rotated perpendicular to the axis of obervation.

EXAMPLE 5

1450 gms. of the same coal tar distillate as described in Example 1 were charged into the closed reaction vessel, were heated to a temperature of 316° C, and were oxidized or blown with air for 4 hours at elevated pressure of 86 psig while maintaining the distillate at a temperature of 316° C. The air was introduced as a fine dispersion of air into the coal tar distillate at the bottom of the reactor at a rate of 1.87 scf/kg/hr. From an oxygen balance, it was found that the total amount of elemental oxygen that was consumed was 57 gms. of elemental oxygen per kilogram of coal tar distillate. The air-blown distillate had the following distillation range as determined by ASTM test D246:

| | |
|---|---|
| IBP (Initial Boiling Point) | 239° C |
| Cumulative Distillate | |
| to 270° C | 5.2% |
| to 300° C | 10.4% |
| to 315° C | 14.2% |
| to 326° C | 21.5% |
| to 355° C | starts to decompose |
| Softening Point | 124° C C/A |

An aliquot of the air-blown distillate was removed from the reaction vessel and placed into a refractory dish in the electric kiln. The kiln was purged with nitrogen gas. The aliquot was carbonized in the kiln by gradually heating it at 3°/minutes up to 1000° C and holding it at that temperature for 1 hour while the inert atmosphere at nitrogen gas was maintained in the kiln.

A sample was prepared from the carbonized aliquot and examined under a metallographic microscope at a magnification of 800X using polarized light and crossed Nicols. The sample was identified as isotropic carbon, as the intensity of the reflected polarized light did not very as the sample was rotated perpendicular to the axis of observation.

EXAMPLE 6

1720 gms. of a recycle oil (Shell Oil Company's 200X grade recycle oil) were charged into a closed reaction vessel. The recycle oil had been obtained by thermally cracking a petroleum distillate obtained from a petroleum crude oil. This recycle oil had the following distillation range as determined by ASTM test D246:

| | |
|---|---|
| IBP (Initial Boiling Point) | 267° C |
| Cumulative Distillate | |
| to 270° C | 1.3% |
| to 300° C | 31.3% |
| to 315° C | 47.3% |
| to 355° C | 78.9% |
| to 375° C | 87.5% |

The oil in the reaction vessel was heated to a temperature of 250° C and was oxidized or blown with air for 28 hours at atmospheric pressure while maintaining the oil at a temperature of 250° C. The air was introduced as a fine dispersion of air into the recycle oil at the bottom of the reactor at a rate of 0.79 scf/kg/hr. From an oxygen balance, it was found that the total amount of elemental oxygen that was consumed was 80 gms of elemental oxygen per kilogram of recycle oil. Susequently, an aliquot of air-blown recycle oil was removed from the reaction vessel after it had been allowed to cool to ambient temperature and it appeared as a pitch-like substance. The air-blown recycle oil had a pour of 73° C and had the following distillation range as determined by ASTM test D246:

| | |
|---|---|
| IBP (Initial Boiling Point) | 283° C |
| Cumulative Distillate | |
| to 270° C | — |
| to 300° C | 8.1% |
| to 315° C | 19.2% |
| to 355° C | 30.3% |
| to 375° C | 44.6% |

This aliquot of air-blown recycle oil was placed into a refractory dish and placed into a conventional electrical kiln. The kiln was subsequently purged with the nitrogen. The aliquot was carbonized in the kiln by gradually heating it at a rate of 3°/minute up to 1000 ° C and holding it at that temperature for 1 hour while the inert atmosphere of nitrogen gas was maintained in the kiln.

After the aliquot of the air-blown recycle oil was carbonized a sample was prepared as above described and examined under a metallographic microscope at a magnification of 800X using reflected polarized light and crossed Nicols. The sample was identified as isotropic carbon as the intensity of reflected polarized light did not vary as the sample was rotated perpendicular to the axis of observation.

What is claimed is:

1. A method for preparing isotropic carbon fibers from hydrocarbon distillates selected from coal tar distillates boiling between about 200° to 400° C, straight run petroleum distillates boiling between about 200° to 600° C and catalytically cracked recycle petroleum distillates boiling between about 200° to 500° C comprising:

a. reacting the distillate with a gas containing elemental oxygen at a temperature of from about 250° to about 420° C until at least 0.5 standard cubic foot of elemental oxygen is reacted per pound of distillate and the distillate is converted to a pitch like substance which yields isotropic carbon upon subsequent carbonization;

b. forming a fiber from the oxidized hydrocarbon distillate;

c. carbonizing the fiber in an inert atmosphere at temperatures in excess of 800° C.

2. A method as in claim 1 wherein the gas containing elemental oxygen is air.

3. A method as in claim 1 wherein the oxidized distillate is distilled to remove the low boiling constituents prior to being formed into a fiber.

4. A method for preparing isotropic carbon fibers from hydrocarbon distillates selected from coal tar distillates boiling between about 200° to 400° C, straight run petroleum distillates boiling between about 200° to 600° C and catalytically cracked recycle petroleum distillates boiling between about 200° to 500° C comprising:

a. reacting the distillate with a gas containing elemental oxygen at a temperature of from about 250° to about 420° C until at least 0.5 standard cubic foot of elemental oxygen is reacted per pound of distillate and the distillate is converted to a pitch-like substance which yields isotropic carbon upon subsequent carbonization;

b. distilling the oxidized distillate until it has a cube in air softening point of from about 80° C to about 200° C;

c. forming a fiber from the oxidized hydrocarbon distillate;

d. carbonizing the fiber in an inert atmosphere at temperatures in excess of 800° C.

5. A method as in claim 4 wherein the oxygen containing gas is air.

* * * * *